United States Patent [19]

Raub

[11] Patent Number: 4,880,243

[45] Date of Patent: Nov. 14, 1989

[54] PORTABLE PLAYING COURT DEMARCATION APPARATUS AND METHOD FOR FABRICATION THEREOF

[76] Inventor: Walter B. Raub, 2111 Union Way, Lakewood, Colo. 80215

[21] Appl. No.: 304,565

[22] Filed: Jan. 31, 1989

[51] Int. Cl.[4] ..... A63B 71/02

[52] U.S. Cl. ..... 273/411; 273/31

[58] Field of Search ..... 273/411, 29 R, 31

[56] References Cited

U.S. PATENT DOCUMENTS

| | | | |
|---|---|---|---|
| 324,649 | 8/1885 | Brown | 273/31 |
| 391,660 | 10/1988 | Thayer | 273/31 |
| 638,220 | 12/1899 | De Wolf | 273/411 X |
| 1,605,662 | 11/1926 | Kayser | 273/31 |
| 3,039,197 | 6/1962 | Abbott | 273/31 X |
| 3,226,118 | 12/1965 | Nehl | 273/411 X |
| 3,231,278 | 1/1966 | Boulanger | 273/411 X |
| 3,393,913 | 7/1968 | Safina | 273/411 X |
| 3,968,968 | 7/1976 | Peterson | 273/411 |
| 3,980,299 | 9/1976 | Brown | 273/29 R |
| 3,985,359 | 10/1976 | Moore | 273/411 |
| 4,088,317 | 5/1978 | Gierla | 273/31 |

FOREIGN PATENT DOCUMENTS

| | | | |
|---|---|---|---|
| 599727 | 3/1948 | United Kingdom | 273/411 |

*Primary Examiner*—William H. Grieb

*Attorney, Agent, or Firm*—Timothy J. Martin; J. Preston Oxenham

[57] ABSTRACT

A portable playing court demarcation apparatus, for marking the bounds of a rectangular playing court, comprises a flexible outer boundary demarcation element the ends of which are joined to one another to form an endless element of a length greater than the perimeter of the playing court to be marked. The demarcation element includes four loop segments, each of the loop segments forming a corner loop of predetermined circumference, the element crossing itself at a corner point at the base of each loop at a generally right angle such that the longitudinal distance along the demarcation element between consecutive loops is alternately equal to the court length and the court width. The playing court demarcation apparatus may be fabricated by providing an elongate flexible element having a first and second end and a length greater than the distance about the perimeter of the court, attaching the first and second ends of the element to one another to form an endless loop, defining two court end segments of the loop a length equal to the width of the game court and two court side segments of the loop with a length equal to the length of the court to occur alternately about the loop and to be separated by four loop segments of generally uniform length, rotating the two court end segments one full revolution about their longitudinal axis to cause each of the looop portions to twist one full revolution over its length, and attaching the ends of each loop segment to one another to form corner loops.

22 Claims, 5 Drawing Sheets

PORTABLE PLAYING COURT DEMARCATION APPARATUS AND METHOD FOR FABRICATION THEREOF

TECHNICAL FIELD

The present invention relates to the field of marking the boundaries of playing courts for playing games in general and to marking the boundaries of courts for playing volleyball in particular.

BACKGROUND OF THE INVENTION

Since before written history, man has demonstrated his gregarious and social nature by engaging in games, particularly sports played with a ball within the bounds of a stadium or marked court. Ruins of courts for such ball sports have been found in Central America which date back thousands of years. Today, many amateur ball court sports are played on a spontaneous basis in backyards, parks and on beaches where no formal game courts exist.

Volleyball is a popular amateur sport which is frequently played informally at social gatherings. Often, a net will be erected and a court marked out on whatever unobstructed playing surface is available with rocks, branches, bottles, or any other objects which may be available as improvised markers to define the bounds of play. When possible, it is particularly popular to lay out volleyball playing courts on soft sandy surfaces, such as a beach, or a prepared playing surface covered with a deep layer of soft sand. In summer months, such volleyball playing surfaces are particularly popular because they allow comfortable play in bare feet.

Portable systems for marking the boundaries of tennis courts, and which may be adapted to the marking of volleyball and other sports courts, are known but have many disadvantages and may present hazards to volleyball players when used in environments of informal volleyball play. U.S. Pat. No. 3,985,359, to Moore, describes a portable sports court boundary for tennis or volleyball courts formed of flexible cord or twine which may be wound on a specially constructed spool and unrolled and placed on a surface where it is desired to play a game. The twine boundary of that boundary marking device is anchored to the playing surface by spikes with hooks which hook over the cord boundary when the spikes are driven into the playing surface. A mini-volleyball layout is described in U.S. Pat. No. 3,968,968, to Peterson, which utilizes corner weights to hold a flexible cord between them, thereby defining a playing court. The weights, which are circular and have a channel cut in their base to receive the twine, are located at each corner of the court of Peterson's layout. A collapsible boundary frame for games is described in U.S. Pat. No. 3,226,118, to Nehl, which utilizes rigid members joined by rigid elbows to define the boundaries of a playing court.

Each of these playing court marking devices has inherent disadvantage and may present hazards to game players, particularly when utilized to mark playing courts on soft surfaces such as deep sand. Anchoring systems, such as that suggested by Moore, which utilize hooks or other devices which cooperate with the cord boundary, are a hazard to barefoot players who may easily step on the cord boundary at the location of an elevated portion of an anchoring device causing injury to the player's unprotected feet. Such foot injuries, as well as ankle injuries, may be caused by weighting devices, particularly where weights intrude upon the interior playing area of the court, at the back court corners of the court as do those suggested by Peterson. Where rigid boundary defining members, such as those suggested by Nehl, are utilized, the entire court boundary presents similar hazards.

The structures of known portable playing court marking technology do not provide an effective and economic method of manufacturing a portable court boundary demarcation apparatus which sharply defines square playing court corners. Corner weights, such as those of Peterson, with radiused channels for receiving the boundary defining flexible cord, obliterate the square corners of the back court. Both flexible boundary defining members, as employed by Moore, and rigid court defining members, as employed by Nehl, require that the members be cut and either rejoined or joined to special corner forming members to achieve sharp right angled corners at the back court boundary when fabrication techniques of the present portable court boundary art are utilized.

DISCLOSURE OF THE INVENTION

It is an object of the present invention to provide a portable playing court boundary which may be readily deployed on a playing surface to mark the bounds of a court for playing a game and readily removed from the surface and stored when not in use.

It is a further object of the present invention to provide a portable playing court boundary which has sufficient mass at its corners to maintain its position on a playing surface without auxiliary weights or surface engagement devices.

It is yet a further object of the present invention to provide a portable playing court boundary which may be engaged with surface position retention devices, such as weights or spike devices, while minimizing the possibility of a game player steeping on a surface position retention device and the hazards associated with such occurrences.

It is another object of the present invention to provide a portable playing court boundary which will sharply define the back corners of a playing court while eliminating the need to cut the playing court boundary defining element and rejoin it with itself or join it with corner forming members during the course of manufacture.

It is an additional object of the present invention to provide a portable court boundary demarcation apparatus which may be fabricated of a single continuous boundary defining element while providing sharp definition of right angled corners at the back boundaries of a playing court.

It is still a further object of the present invention to provide a portable playing court boundary demarcation apparatus that accomplishes the above objectives while having a pleasing appearance and form.

A preferred embodiment of the portable playing court demarcation apparatus of the present invention, for marking the bounds of a rectangular playing court, comprises a flexible outer boundary demarcation element, preferably manufactured of a length of rope or cloth tape material, the ends of which are joined to one another to form an endless element of a length greater than the perimeter of the playing court to be marked. The demarcation element further includes four loop segments, each of the loop segments forming a corner loop of predetermined circumference, the element crossing itself at a point of crossing at the base of each loop at a generally right angle such that the longitudinal distance along the demarcation element between consecutive loops is alternately equal to the court length and the court width.

To mark a playing court, the court boundary demarcation apparatus is laid upon a playing surface with each of the points of crossing at the base of the corner loops of the demarcation element at a back court corner with the corner loops extending outwardly from the playing court. Once deployed, the mass of the loops assists in maintaining the position of the corners and thus the position of the demarcation element on the court boundaries. Alternatively, mushroom headed spikes or U-shaped spikes may be utilized to engage the loops outside the court corners and anchor the demarcation apparatus to the ground. Thus, the corner loops of the portable court demarcation apparatus not only provide definitive marking of the square corners of the court but also allow anchoring devices to be located away from the playing court boundary to minimize the risk of injury to game players.

A preferred embodiment of the playing court demarcation apparatus may be fabricated by first selecting an elongate flexible element, preferably cloth tape, having a first and second end and a length greater than the distance about the perimeter of the court; attaching the first and second ends of the element to one another to form an endless loop; defining two court end segments of the loop with a length equal to the width of the game court and two court side segments of the loop with a length equal to the length of the court to occur alternately about the loop and to be separated by four loop segments of generally uniform length; rotating the two court end segments one full revolution about their longitudinal axes to cause each of the loop portions to twist one full revolution over its length; and attaching the ends of each of the loop segments to one another to form corner loops.

These and other features and advantages of the present invention will become apparent upon consideration of the following specification and claims, together with the accompanying drawings.

DETAILED DESCRIPTION OF THE INVENTION

Figure 1:
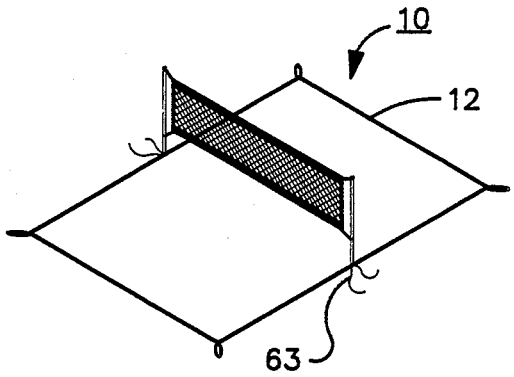
FIG. 1 is an isometric view of the portable playing court demarcation apparatus of the present invention deployed on a playing surface.
Figure 2:
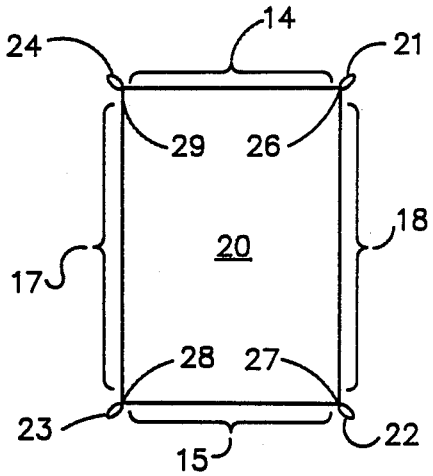
FIG. 2 is a plan view of the portable playing court demarcation apparatus of the present invention deployed on a playing surface.

FIG. 1 shown an exemplary preferred embodiment of a portable playing court demarcation apparatus 10 comprising the present invention, deployed on the surface of a rectangular court for playing volleyball. The plan form of the exemplary preferred embodiment when deployed on a playing surface is shown in FIG. 2. When deployed, the portable boundary demarcation apparatus encloses a rectangular center opening 20 defining the court and has four looped segments 21, 22, 23, 24 which form corner loops extending outwardly from each court corner. Portable playing court demarcation apparatus 10 includes a flexible outer boundary demarcation element 12, which may be manufactured as a continuous, endless element, or manufactured as a strip with two ends which may be permanently or detachably attached to one another to form a continuous, endless element. Demarcation element 12 is preferably fabricated of rope or cloth tape, but may be manufactured of any suitably flexible and durable material. Boundary demarcation element 12 includes court end segments 14 and 15, each of a length 'w' equal to the width of the playing court to be marked, and court side segments 17 and 18, each of length '1' equal to the length of the playing court to be marked. Demarcation element 12 further comprises four looped segments 21, 22, 23, 24, each of which forms a corner loop of predetermined circumference. In the preferred embodiment, demarcation element 12 crosses itself at generally a right angle at corner points 26, 27, 28, 29 at the base of each of corner loops 21, 22, 23, 24, respectively. As shown in FIGS. 3*a*and *b*, demarcation element 12 is attached to itself at corner points 21, 22, 23, 24 by whipping with twine or wire 31, clamping with a metal staple 33, or by any other suitable means for attachment. Where demarcation element 12 is fabricated of twisted rope, the rope may be interbraided at the point of crossing as shown in FIG. 3*c*. When fabricated of a flat cloth tape, demarcation element 12 may be attached to itself at corner points 21, 22, 23, 24 by sewing the tape flat against itself as shown in FIG. 3*d*or may be detachably attached by, for example, hook and loop fasteners 70 as shown in FIG. 3e. When demarcation element 12 is fabricated of cloth tape, the tape is preferably twisted one full turn over the length of each loop segment 21, 22, 23, 24, as shown in FIG. 3*d*, to minimize bunching of the tape and allow the tape to readily lie flat against itself to facilitate attachment at corner points 26, 27, 28, 29 by, for example, sewing, application of adhesives or fusion by heat.

Figure 3:
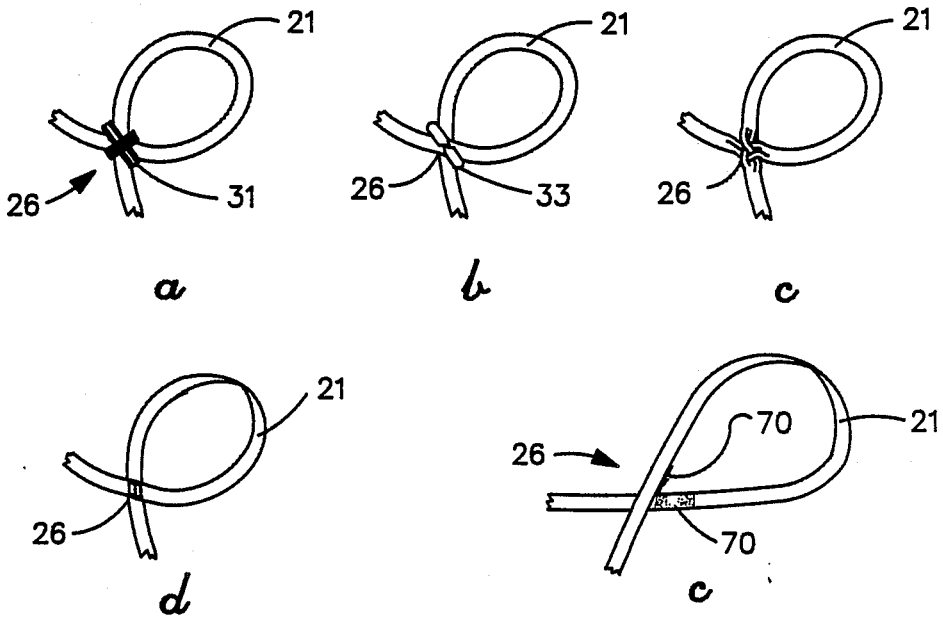
FIG. 3*a, b, c, d, e* illustrates means of attaching the ends of the loop segments of the demarcation element to one another.

As may be seen from FIG. 3, in the preferred embodiment, by turning the demarcation element through a 270 degree loop to the outside of the court at the corners, in a plane parallel to that of the playing surface, a square inside court corner demarcation may be achieved without need to cut and rejoin the demarcation element 12 or cut the demarcation element 12 and insert and fasten a square corner member within it during manufacture.

Figure 4:
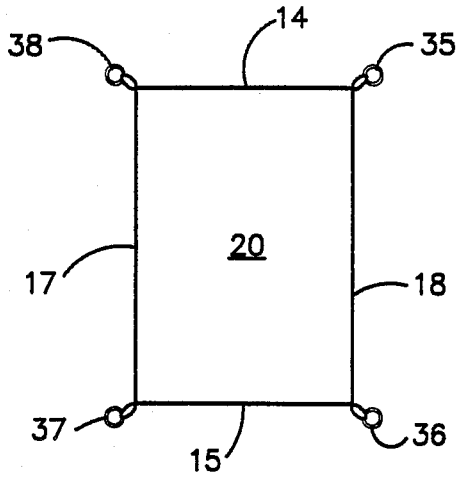
FIG. 4 is a plan view of the portable playing court demarcation apparatus of the present invention deployed on a playing surface and anchored to the playing surface by anchoring devices.
Figure 5:
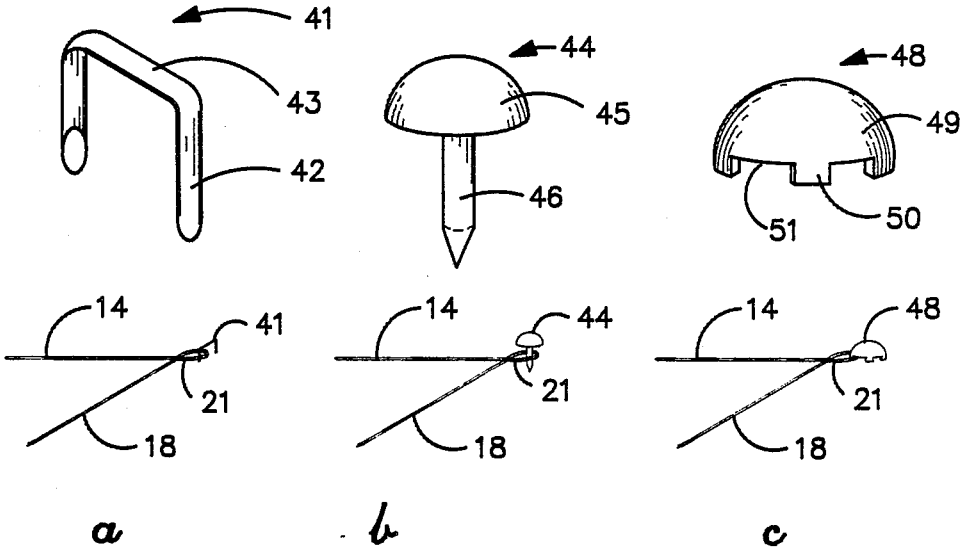
FIG. 5*a, b c* illustrates staple-like spike, mushroom-like spike and weight type anchoring devices.

The concentration of mass at the corners of the portable playing court boundary demarcation apparatus which results from the presence of the corner loops formed by loop segments 21, 22, 23, 24 helps maintain the corner points 26, 27, 28, 29 in place and thus the side segments 17, 18 and end segments 14, 15 of boundary demarcation element 12 in place. Where it is desired to fix the portable playing court demarcation apparatus of the present invention upon the playing surface more securely, anchoring devices may be utilized in conjunction with the outward projecting corner loops formed by loop segments 21, 22, 23, 24 to place the side segments 17, 18 and end segments 14, 15 in tension and hold them in place while allowing the side segments 17, 18 and end segments 14, 15 to remain free of anchoring devices which may cause injury to game players. As shown in FIGS. 4 and 5, anchoring devices 35, 36, 37, 38 need engage only the outermost extremities of the corner loops to tension side segments 17, 18 and end segments 14, 15. Thus, anchoring devices 35, 36, 37, 38 are placed a distance outside the playing court area 20 where the risk of tripping a player or injuring a player's foot is greatly reduced. Anchoring devices 35, 36, 37, 38 may be surface engagement devices, such as the U-shaped, staple-like spike 41 with legs 42 and bridge portion 43 shown in FIG. 5*a*, or mushroom-like capped spike 44 with capped portion 45 and spike portion 46 as shown in FIG. 5*b*, or, particularly where hard surfaces make spike-type devices impractical, corner weights 48 as shown in FIG. 5*c*. Preferably, all protruding portions of anchoring devices, such as the bridge portion 43 of U-shaped spike 41, head portion 45 of mushroom-shaped spike 44 and body portion 49 of corner weight 48 are rounded to further minimize the possibility of injury to players. Corner weights may have legs 50, or channels 51 to aid in engaging corner loops formed by loop segments 21, 22, 23, 24 of the demarcation element 12, but may be of any suitable shape. Anchoring devices may be fabricated of any suitable material, for example, plastic or metal, and may be coated with vinyl or other soft material to further minimize the possibility of injury to players.

Figure 6:
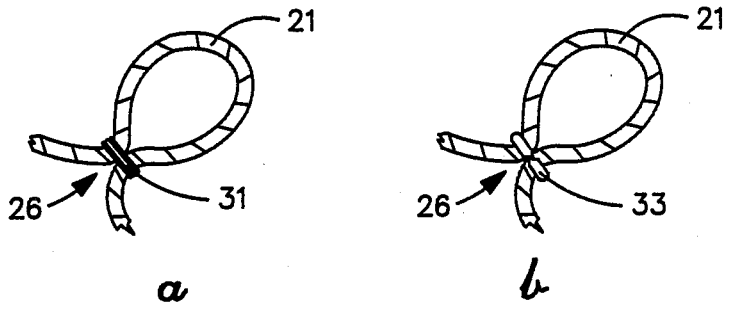
FIG. 6*a, b* illustrates methods of attaching the end points of the loop segments of the demarcation element in an alternative embodiment.

Loop segments 21, 22, 23, 24 of demarcation element 12 of an alternative embodiment are shown in FIG. 6, in which the end points of each loop segment 21, 22, 23, 24 are joined without crossing. As in the case of the embodiment of FIG. 3, the end points of each loop segment 21, 22, 23, 24 may be attached, for example, by whipping with twine or metal wire 31 or clamping with metal staples 33, as shown in FIGS. 6*a*, respectively, or by any suitable means.

Figure 7:
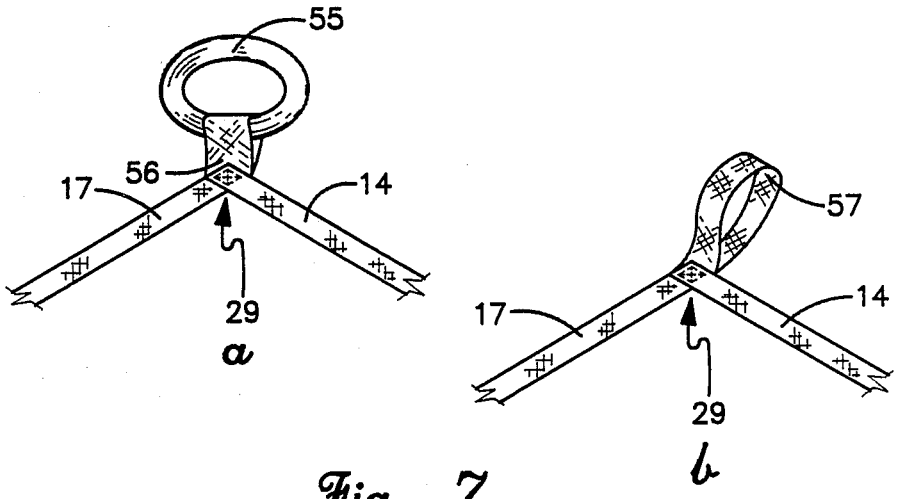
FIG. 7*a, b* shows methods of forming corner loops in alternative embodiments.

Additional alternative embodiments of the portable playing court demarcation apparatus are shown in FIGS. 7*a* and *b*. In exemplary alternative embodiments of FIG. 7*a* and *b*, the boundary demarcation element 12 is of a length equal to the court perimeter and is fabricated of separate portions comprising side segments 17 and 18 and end segments 14 and 15 which are sewn or otherwise attached to one another at the corners of the court boundary. In the embodiment of FIG. 7*a*, corner ring 55 is attached to boundary demarcation element 12 at the court corners by fastening strap 56 in a manner which allows ring 55 to extend outside of the playing court. In the exemplary alternative embodiment of FIG. 7*b*, a cloth loop 57 is sewn into the corner joining point.

Figure 8:
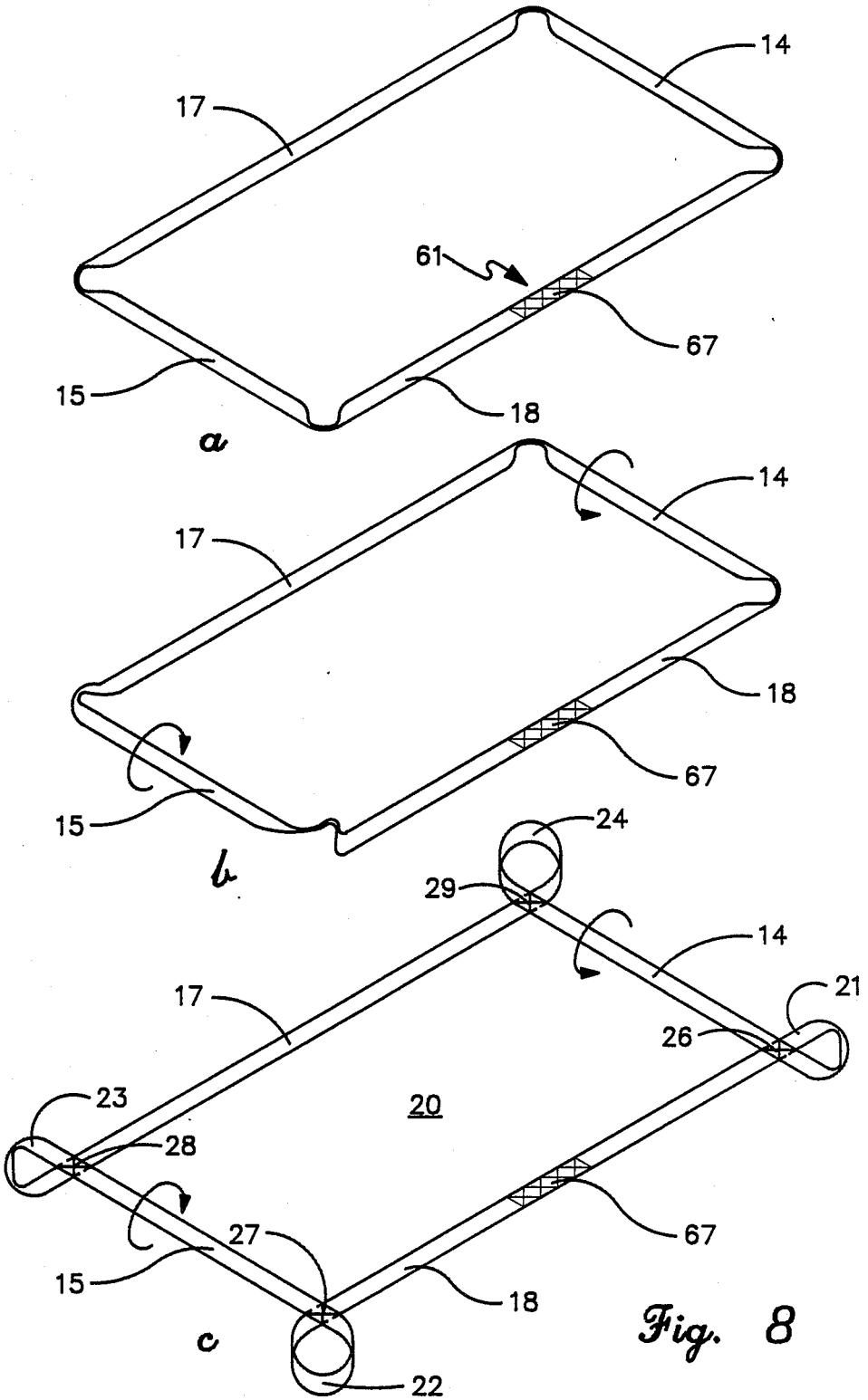
FIG. 8*a, b, c*illustrates a method of fabricating the portable playing court demarcation apparatus of the present invention.

A first method for fabrication of a portable playing court demarcation apparatus comprising the preferred embodiment of the present invention, of cloth tape, is illustrated in FIG. 8*a*, *b* and *c*. The ends of a length of cloth tape 12, which is of greater length than the perimeter of the playing court to be marked, are attached to one another at 61 to form an endless loop. The ends may be fixedly attached, for example by sewing, adhesives or heat fusion, or may be detachably attached, for example by hook and loop fasteners or snaps. Two side segments 17 and 18, of a length equal to the length of the court to be marked, and two end segments 14 and 15, of a length equal to the width of the court to be marked, are defined along the length of the cloth tape such that they occur alternatively about the loop and such that adjacent segments 14, 15, 17, 18 are separated by loop segments of generally uniform length. Attachment point 61 may, of course, lie in any one of the segments. The endless loop is then laid out in a roughly rectangular pattern on a work surface so that the cloth tape is untwisted and a single side of the cloth tape is in contact with the work surface, and side segment 17 and 18 oppose one another and end segments 14 and 15 oppose one another. End segments 14 and 15 are then rotated one full revolution about their longitudinal axis, preferably each toward the inside of the rectangle as shown in FIGS. 8*b*, and *c*, to cause each of loop segments 21, 22, 23, 24 to twist one full revolution and allow the end points of each loop segment 21, 22, 23, 24 to be laid flat upon one another and be attached to one another, for example, by sewing, at points of crossing 26, 27, 28, 29.

Figure 9:
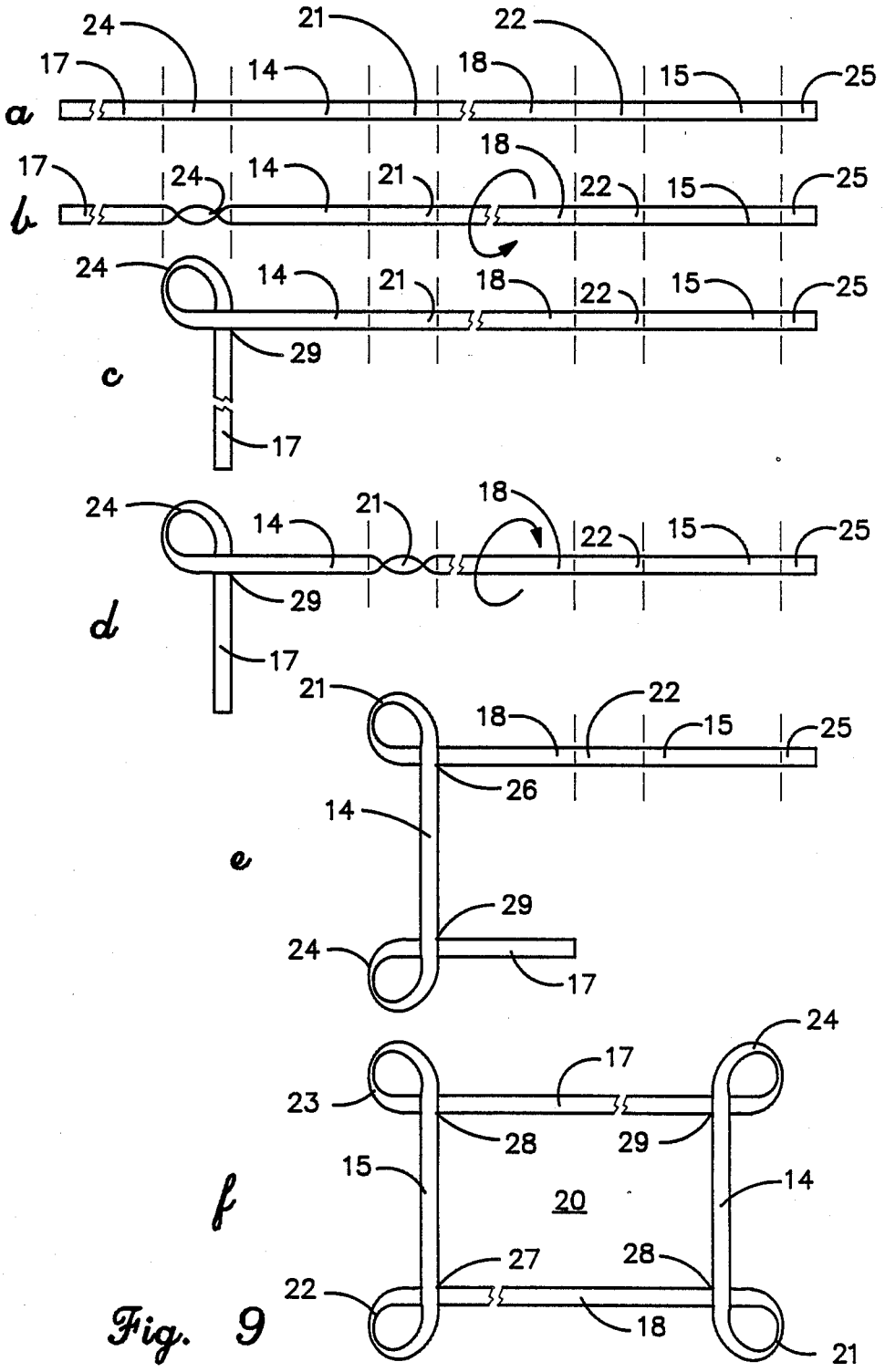
FIG. 9*a–f* illustrates an alternative method of fabricating a portable playing court demarcation apparatus.

An alternate method by which a portable playing court demarcation apparatus comprising a preferred embodiment of the present invention may be fabricated of cloth tape is illustrated in FIG. 9. Beginning with a length of cloth tape, the length of which exceeds the perimeter of the playing court to be marked by four times the length of each looped portion 21, 22, 23, 24, is divided into consecutive portions along its length corresponding to the length of side segment 17, loop segment 24, end segment 14, loop segment 21, side segment 18, loop segment 22, end segment 15 and loop segment 23, respectively, as shown in FIG. 9*a*. Segment 17 is then maintained in place while the portion of element 12 beyond segment 24 is rotated one full turn about its longitudinal axis to cause a twist of one full revolution over segment 24, as shown in FIG. 9*b*. Segment 17 is then rotated 90 degrees, counterclockwise in FIG. 9, about an axis perpendicular to the plane of the cloth tape and the end points of segment 24 are attached as shown in FIG. 9c. The portion of the cloth tape beyond segment 21 is then rotated one full revolution about its longitudinal axis, preferably in a direction opposite to the rotation of step b, to cause segment 21 to be twisted one full revolution over its length in a direction opposite to segment 24. Segment 14 is then rotated 90 degrees about an axis normal to the plane of the tape, in the same direction as the rotation of segment 17 in step a, and the ends of segment 21 are attached to one another in the same manner as the ends of segment 24. In a similar manner, a twist of one full turn in alternating directions is imposed upon each of loop sections 22 and 23, and their end points are attached to one another. Finally, the free end of boundary element 12 at the end of side segment 17 is attached at the base of the corner loop formed by loop segment 23 to complete fabrication of the portable playing court boundary apparatus as shown at 9f.

Figure 10:
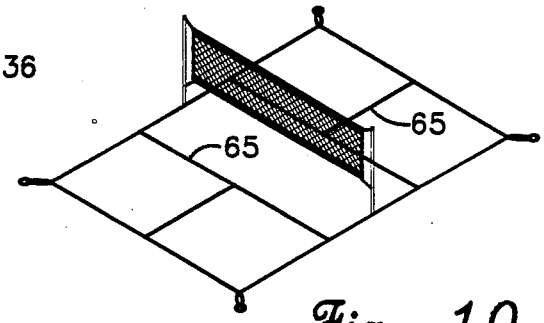
FIG. 10 is an illustration of an alternative embodiment incorporating inner court marking elements.

To aid in the arrangement of equipment, such as a playing net, on the playing court, the center of side segments 17 and 18 may be marked by a center marking element 63 which may be, for example, colored band or ribbon or twine tied to or braided into the boundary demarcation element 12. The demarcation element is preferably a bright color which can readily be seen against the playing surface. Side segments 17, 18 may be made of a different color from end segments 14 and 15. Other court markings, for sports such as badminton, may be provided by attaching inner court marking elements 65 to side and end segments 14, 15, 17, 18 as illustrated in FIG. 10. The portable boundary demarcation apparatus of the present invention may be stored by hanging it by its corner loops, or stuffing it into a storage sack. Alternatively, praticularly where detachable attachment means such as hook and loop fasteners 67 and 70 are utilized to form an endless demarcation element from a strip and to attach the demarcation element to itself at the corner points, the boundary demarcation apparatu may be coiled or rolled in a spool for storing.

While an exemplary portable playing court boundary demarcation apparatus comprising the present invention and a method for its fabrication have been shown, it will be understood, of course, that the invention is not limited to that embodiment. Modification may be made by those skilled in the art, particularly in light of the foregoing teachings. For example, when the demarcation element 12 is fabricated of cloth tape, the loop segments 21, 22, 23, 24 may all be twisted in the same direction, or not twisted at all. The structure and method of manufacture of the present invention may be adapted to mark the boundary of any court with a plan form shape of a convex polygon. It is, therefore, contemplated by the appended claims to cover any such modification which incorporates the central features of this invention or encompasses the true spirit and scope of the invention.

I claim:

1. A portable playing court demarcation apparatus for marking a boundary of a rectangular court for playing a game, the court having back boundaries of a length equal to a court width and side boundaries of a length equal to a court length defining a court perimeter, the apparatus comprising:

a continuous, endless flexible outer boundary demarcation element of a length greater than a distance about the perimeter of the court to be marked, said demarcation element including four loop segments, each loop segment forming a loop of predetermined circumference, the element crossing itself at a corner point at the base of each loop at generally a right angle such that the longitudinal distance along said demarcation element between consecutive loop segments is alternately equal to the court length and the court width.

2. A portable playing court demarcation apparatus as in claim 1 further comprising:

means for attaching said demarcation element to itself at said corner points.

3. A portable playing court demarcation apparatus as in claim 1 in which said demarcation element is a rope.

4. A portable playing court demarcation apparatus as in claim 1, in which said demarcation element is a cloth tape.

5. A portable playing court demarcation apparatus as in claim 2 in which said attachment means comprises a hook and loop fastener.

6. The portable playing court demarcation apparatus of claim 2, further comprising:

an inner court marking element attached to said demarcation element.

7. The portable playing court demarcation apparatus of claim 2, further comprising a center marking element attached to said side segments of said demarcation element.

8. The portable playing court demarcation apparatus of claim 1, in which said demarcation element comprises detachable attachment means.

9. The portable playing court demarcation apparatus as in claim 8 in which said detachable attachment means comprises a hook and loop fastener.

10. A portable playing court demarcation apparatus for marking a boundary of a rectangular court for playing a game, the court having opposing back boundaries each of a length equal to a court width and opposing side boundaries each of a length equal to a court length defining a court perimeter, the apparatus comprising:

a continuous, endless flexible boundary demarcation element of a length equal to a length of the perimeter of the court to be marked;

extension elements, said extension elements fixed to said demarcation element at intervals which are alternately of a first and second length, said first and second length equal to the court width and court length, respectively; and means for anchoring said extension elements to a surface upon which the court is to be marked.

11. A portable playing court demarcation apparatus as in claim 10 in which said extension elements are cloth loops.

12. A portable playing court demarcation apparatus as in claim 10 in which said extension elements are rings.

13. A portable playing court demarcation apparatus as in claim 10 in which said anchoring means comprises a mushroom-shaped stake.

14. A portable playing court demarcation apparatus as in claim 10 in which said anchoring means comprises a U-shaped stake.

15. A portable playing court demarcation apparatus as in claim 10 in which said anchoring means comprises a weight.

16. A method for fabricating a portable playing court demarcation apparatus for marking a boundary of a rectangular court for playing a game, the court of predetermined length and width and having two opposing sides, two opposing ends and a perimeter, the method comprising:

a. providing an elongate flexible element having a first and second end which are separated by a distance greater than a distance about the court perimeter when said element is fully extended;

b. attaching said first end of said element and said second end of said element to one another to form an endless loop;

c. defining two end segments of said loop of a length equal to the width of the game court and two side segments of said loop of a length equal to the length of said court, said end segments and said side segments occurring alternately about said loop, adjacent end and side segments separated by a loop segment of generally uniform length, each loop segment having a first and second end; and d. attaching the first and second end of each loop segment to one another to cause said loop segments to form loops.

17. The method for fabricating a portable playing court demarcation apparatus as in claim 16 in which said elongate flexible element is rope.

18. A method for fabricating a portable playing court demarcation apparatus as in claim 16 in which said elongate flexible element is cloth tape.

19. The method for fabricating a portable playing court demarcation apparatus as in claim 17 further comprising the step of rotating each of said end segments one full turn about their longitudinal axes after Step c and before Step d.

20. The method for fabricating a portable playing court demarcation apparatus as in claim 19, in which said end segments are rotated in opposite directions.

21. A method for fabricating a portable playing court demarcation apparatus for marking a boundary of a court for playing a game, the court of predetermined length and width and having two opposing sides, two opposing ends, and a perimeter, the method comprising:

a. providing an elongate, flexible element to have a first and second end and a length equal to twice the court length plus twice the court width plus four times a predetermined corner loop circumference;

b. measuring along said element from said first end, a distance equal to the court length to determine a first point along said element;

c. measuring a further distance along said element from said first point, a distance equal to the predetermined corner loop circumference to determine a second point along said element;

d. attaching said first point to said second point to form a loop;

e. measuring a further distance along said element from said second point, a distance equal to the court width, to determine a third point along said element;

f. measuring a further distance along said element from said third point, a distance equal to the predetermined corner loop circumference, to determine a fourth point along said element;

g. attaching said third point to said fourth point to form a loop;

h. measuring a further distance along said element from said fourth point, a distance equal to the court length to determine a fifth point along said element;

i. measuring a further distance along said element from said fifth point, a distance equal to the predetermined corner loop circumference, to determine a sixth point along said element;

j. attaching said fifth point to said sixth point to form a loop;

k. measuring a further distance along said element from the sixth point a distance equal to the court width to determine a seventh point along said element;

l. attaching said seventh point to said second end of said element; and m. attaching said second end of said element to said first end of said element.

22. A method for fabricating a portable playing court demarcation apparatus as in claim 21, in which said elongate element is cloth tape, the method further comprising the steps of rotating the remaining length of the elongate element one full turn about its longitudinal axis immediately after each of the steps b, e, h, and k.

* * * * *